United States Patent [19]

Shaffer

[11] 3,968,359

[45] July 6, 1976

[54] FLUORESCENT LAMP

[76] Inventor: Richard Shaffer, c/o George Spector, 3615 Woolworth, Bldg., 233 Broadway, New York, N.Y. 10007

[22] Filed: June 3, 1974

[21] Appl. No.: 475,585

[52] U.S. Cl. ..... 240/51.11 R; 240/10 R

[51] Int. Cl.[2] ..... H05B 33/02

[58] Field of Search ..... 240/10 R, 51.11 R, 81 R, 240/81 LD, 92, 100, 128

[56] References Cited

UNITED STATES PATENTS

| | | | |
|---|---|---|---|
| 2,551,710 | 5/1951 | Slaughter | 240/51.11 R |
| 2,834,873 | 5/1958 | Cooper | 240/51.11 R X |
| 2,907,868 | 10/1959 | Henschel | 240/51.11 R X |
| 3,230,360 | 1/1966 | Short | 240/51.11 R |
| 3,684,882 | 8/1972 | Mininno et al. | 240/10 R |
| D148,227 | 12/1947 | Galehouse | 240/81 R UX |

*Primary Examiner*—Fred L. Braun

[57] ABSTRACT

A fluorescent lamp having a base for supporting the lamp, a transparent member surrounding the lamp and mounted on the base, and at least one translucent element supported by and surrounding the transparent member.

2 Claims, 9 Drawing Figures

FLUORESCENT LAMP

This invention relates generally to ornamental lamps.

A principle object of the present invention is to provide several ornamental lamps for household use, and which incorporate one or more straight fluorescent lamp bulbs as a source of lighting effect.

Another object is to provide fluorescent lamp designs in which a pleasing soft glow is obtained, and the fluorescent bulbs provide a light source that is less expensive to operate than a conventional incandescent bulb so that there is a conservation of energy and saving of money.

Still another object is to provide fluorescent lamp designs which are suitable for use in rooms of different decor such as traditional, modern, and the like.

Still another object is to provide fluorescent lamp designs which save on bulb replacement costs because fluorescent neon bulbs last many times as long as incandescent bulbs, while their very low wattage uses less current so to give equal illumination of incandescent bulbs of larger wattage.

Other objects are to provide a fluorescent lamp design which is simple in design, inexpensive to manufacture, rugged in construction, easy to use and efficient in operation.

These and other objects of the invention will appear from the following specification, it being understood that modifications, variations, and adaptations may be made within the scope of the appended claims.

FIG. 1 is a perspective view of one form of the invention which employed spherical globes.

FIG. 1*a* is a cross sectional view on line 1*a*—1*a* of FIG. 1.

Figure 1:
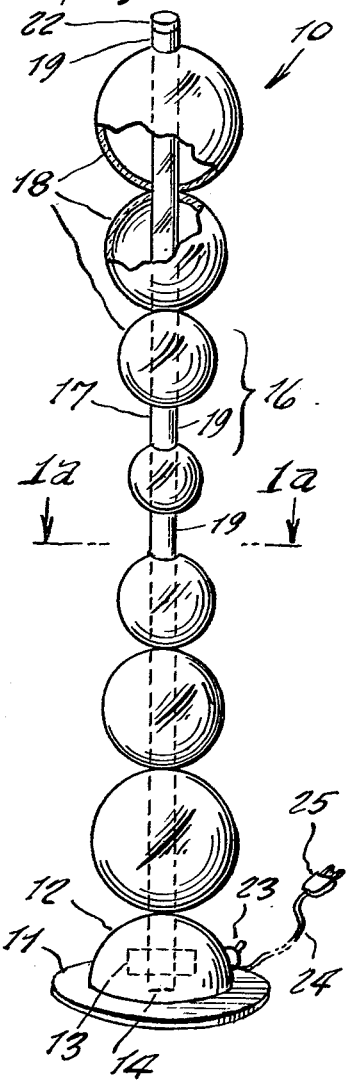
Figure 1A:
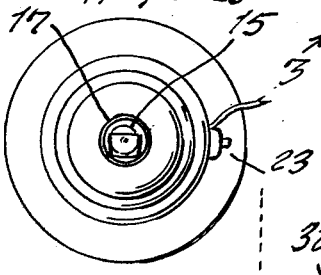

Referring now to the drawings in detail, and more particularly to FIGS. 1 and 1*a* at this time, the reference numeral 10 represents a fluorescent lamp design according to the present invention wherein there is a flat circular base 11 which includes a hemispherical enclosure 12 on its upper side that contains a ballast 13 and a socket 14 for a lower end of a straight, vertical neon or fluorescent bulb 15. The hemisphere 12 is colored black in order to hide the mechanical and electrical components therewithin.

The bulb 15 is enclosed within an exterior case 16 that includes a straight, transparent, support tube 17 that extends the full length of the bulb, and around the outer side of which there are mounted a series of transluscent globes 18, so that, in actuality, the tube 17 extends through the centers of the globes. The gloves are supported on the tubes due to the contact between the tube and the globes.

Figure 8:
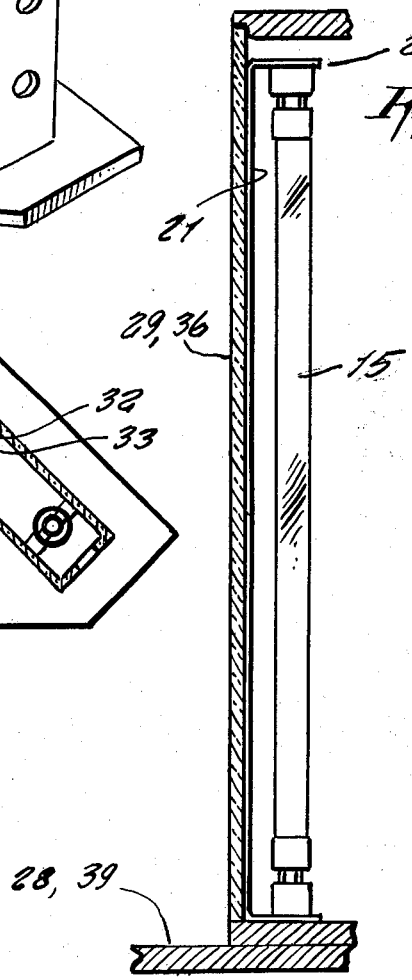
FIG. 8 is a longitudinal cross section of FIG. 5.

As shown, the globes are of various sizes, ranging from six to twelve inches in diameter, and all may be of a white color. The exposed portions 19 of the tube 17 that are located between the globes, can be covered with a black color. The upper end of the bulb 15 can electrically engage a contact 20 which by means of a narrow conductor 21 communicates with the base so to close an electric circuit through the bulb (such as is shown in detail in FIG. 8). The upper end of the tube 17 is enclosed by a black colored cap 22.

It can be now appreciated that lamp 10 is of a style adaptable for use in a Victorian or other decor while providing very inexpensive illumination. The lamp is fitted with a switch 23 and extension cord 24 having plug 25 for connection to a household electric outlet socket (not shown).

Figure 2:
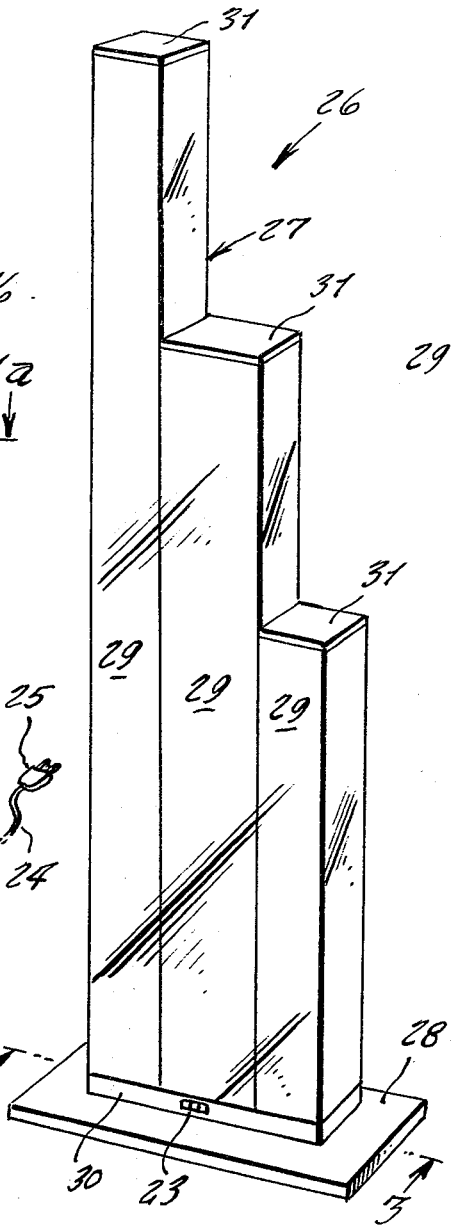
FIG. 2 is a perspective view of a modified design of the invention.
Figure 3:
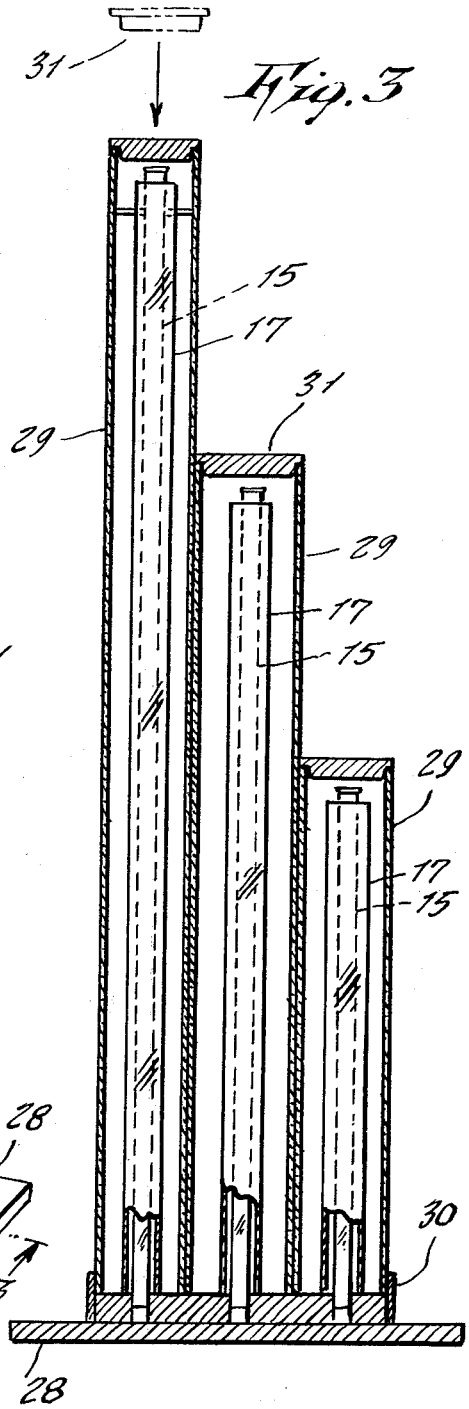
FIG. 3 is a cross sectional view taken on line 3—3 of FIG. 2.
Figure 4:
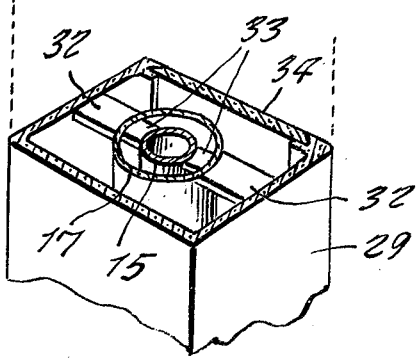
FIG. 4 is an enlarged cross section of one of the tubes of FIG. 2.

In FIGS. 2 through 4, a modified design of lamp 26 is shown consisting of exterior case 27 that includes a base 28 and a series of cross sectionally square tubes 29 mounted thereupon. The base includes an opaque colored band 30 of plexiglass to hide the above described ballasts 13 and sockets 14 for a series of fluorescent bulbs 15, each one of which is located within one of the square tubes 29. The bulbs 15 are likewise fitted in transparent support tubes 17, and the structure also includes the above described contacts 20 and conductors 21. Additionally however, the lamp 26 includes a removable square cap 31 on each tube 29. Also, side braces 32 between tubes 17 and 29 are provided to retain the latter, and spacers 33 on the inner side to tube 17 retain the bulb 15 centrally spaced therewithin.

The tubes 29 are shown to be different length for a pleasing appearance. They may be simply fitted on the base adjacent each within band 30 or they may be cemented together. The tubes 29 are made of transluscent white color. The band 30 supported the off-on switches 23 for each one of the bulbs 15. As shown, the center square tube 29 is wider than the side tubes 29. As shown in FIG. 4, each tube 29 has a vertically slidable rear door 34 that are black in color. The door providing access to the interior for repairs.

Figure 5:
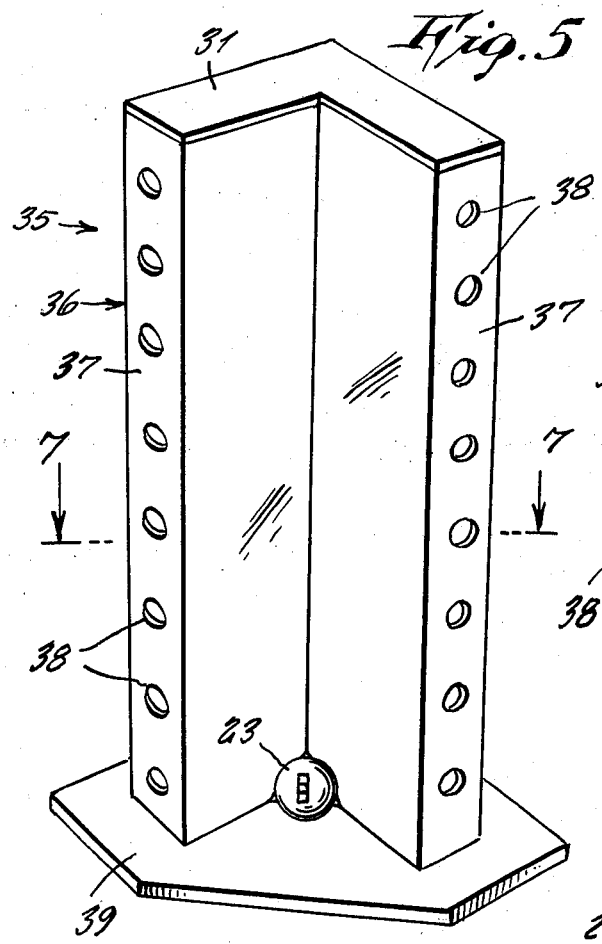
FIG. 5 is a perspective view of another design of the invention.
Figure 6:
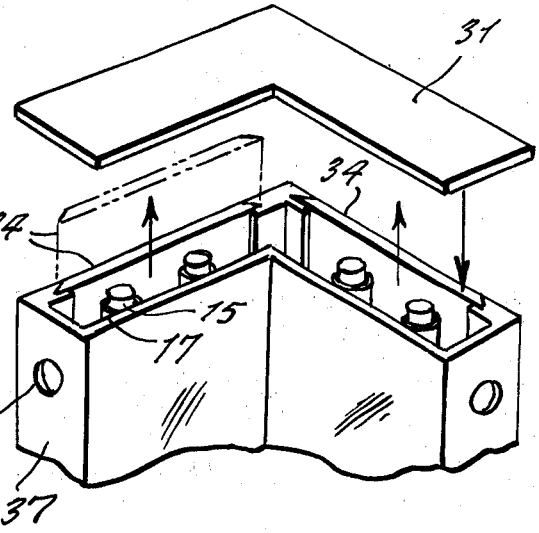
FIG. 6 is a detail of FIG. 5 with the top lid removed.
Figure 7:
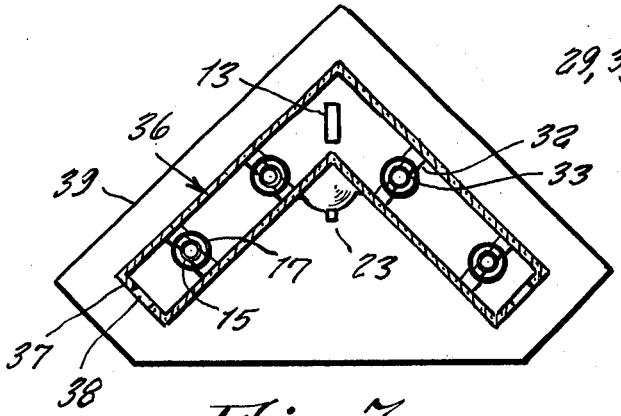
FIG. 7 is a cross section on line 7—7 of FIG. 5.

In FIGS. 5 through 7, a further modified design of lamp 35 is provided which is corner or angle-shaped and which incorporates all the features described above for the lamps 10 and 26, and which are designated with like reference numerals. However, the lamp 35, while having its exterior case 36 made of similar transluscent white material, includes edge strips 37 which are of a different color and which include circular cutout openings 38. Base 39 is of a shape to fit the case 36.

Thus different designs of fluorescent lamps are provided.

While various changes may be made in the detail construction, it is understood that such changes will be within the spirit and scope of the present invention as is defined by the appended claims.

What is claimed is:

1. A fluorescent lamp device comprising a base, an elongated fluorescent lamp extending into and secured to said base, and an enclosing case for said lamp, said case including a transparent vertically extending support tube surrounding said lamp and extending into and secured to said base, and a plurality of various sized translucent outer globes mounted co-axially with and extending along the vertical axis of the tube wherein the globes are in peripheral contact with the tube and supported thereby.

2. A fluorescent lamp device comprising a base, an elongated fluorescent lamp extending into and secured to said base and an enclosing case for said lamp, said case including a transparent vertical support tube surrounding said lamp and extending into and secured to said base, an outer rectangular translucent tube mounted on the base spaced from and surrounding the first said tube, and internal transverse spacer braces extending between said tubes and wherein said outer tube includes longitudinally sliding removable wall.

* * * * *